US007275642B2

(12) United States Patent
Yuhara

(10) Patent No.: US 7,275,642 B2
(45) Date of Patent: Oct. 2, 2007

(54) COSMETIC CASE

(75) Inventor: Yukitomo Yuhara, Chiba (JP)

(73) Assignee: Yoshida Industry Co., Ltd., Tokyo (JP)

( * ) Notice: Subject to any disclaimer, the term of this patent is extended or adjusted under 35 U.S.C. 154(b) by 278 days.

(21) Appl. No.: 10/687,978

(22) Filed: Oct. 20, 2003

(65) Prior Publication Data

US 2004/0226856 A1 Nov. 18, 2004

(30) Foreign Application Priority Data

Oct. 18, 2002 (JP) ..... 2002-304682
Oct. 18, 2002 (JP) ..... 2002-304683

(51) Int. Cl.
*B65D 69/00* (2006.01)

(52) U.S. Cl. ..... 206/581; 206/823; 206/235; 206/1.5; 206/457

(58) Field of Classification Search ..... 206/581, 206/823, 235, 1.5, 457; 220/255, 376, 345.1, 220/345.2, 345.3
See application file for complete search history.

(56) References Cited

U.S. PATENT DOCUMENTS 988,191 A * 3/1911 Heidtmann ..... 206/1.5
1,753,315 A * 4/1930 Parent ..... 132/297
2,062,363 A * 12/1936 Kreisler ..... 132/287
2,220,351 A * 11/1940 Reese et al. ..... 206/131
2,582,593 A * 1/1952 Kramer ..... 132/293
3,342,190 A * 9/1967 Hultgren et al. ..... 132/301
3,586,010 A * 6/1971 Landen et al. ..... 132/287
4,048,050 A * 9/1977 Hillman ..... 206/1.5
4,126,224 A * 11/1978 Laauwe et al. ..... 206/540
4,580,586 A * 4/1986 Kitoh et al. ..... 132/315
4,807,759 A * 2/1989 Castner ..... 220/4.02
4,946,057 A * 8/1990 Connolly et al. ..... 220/481
5,115,930 A 5/1992 Lohrman et al.
5,339,950 A * 8/1994 Li ..... 206/45.23
5,353,947 A * 10/1994 Zinnbauer et al. ..... 220/812
5,590,767 A * 1/1997 Li ..... 206/308.1
5,718,336 A * 2/1998 Haarlander ..... 206/542
6,283,129 B1 * 9/2001 Yuhara et al. ..... 132/295
6,354,308 B1 * 3/2002 Kuk ..... 132/301
6,386,209 B1 * 5/2002 Yuhara et al. ..... 132/294
2005/0115863 A1 * 6/2005 Yuhara ..... 206/581

FOREIGN PATENT DOCUMENTS

FR 856 288 6/1940
JP 2002-101949 4/2002

OTHER PUBLICATIONS

French Preliminary Search Report dated Sep. 16, 2004, issued in counterpart FR Application No. 0312176.

* cited by examiner

*Primary Examiner*—Mickey Yu
*Assistant Examiner*—Steven Pollicoff
(74) *Attorney, Agent, or Firm*—Morrison & Foerster LLP

(57) ABSTRACT

A cosmetic case including a case body and an associated lid opening and closing the same, is adapted to have an ornamental exchangeable cover replaceably attached to at least either of the lid and the case body to cover them, and hence, the cosmetic case satisfies users' demand that all or even part of decorative portion would not peel off nor drop off the case body and its lid and enables customers to take greater initiative in choosing their favorite appearance of the case.

1 Claim, 7 Drawing Sheets

COSMETIC CASE

REFERENCE TO RELATED APPLICATIONS

This application claims the priority of Japanese Patent Application No. 2002-304682, filed Oct. 18, 2002, and Japanese Patent Application No. 2002-304683, filed Oct. 18, 2002, the disclosures of both of which are incorporated herein by reference.

FIELD OF THE INVENTION

The present invention relates to a cosmetic case satisfying users' demands that all or even part of its decorative portion would not peel off nor drop off a case body and its lid and that customers themselves should be able to take greater initiative in choosing their favorite appearance of the case.

BACKGROUND OF THE INVENTION

In general, a cosmetic case is comprised of a case body holding a makeup preparation and a lid associated with the case body to open and close the same. The case body and the lid of the cosmetic case, which are important factors giving an impressive appearance of the cosmetic case, have been ornamented in various ways to be more fashionable in design. For instance, the case body and the lid undergo a surface treatment such as sputtering, a pattern transfer with transfer sheet to print letters and patterns, a laminating sheet treatment where the case body and the lid having a pattern printed is overlaid with a transparent or translucent sheet.

The applicant of this application has previously filed a related application identified with Japanese Patent Application No. 2001-249000.

One of requirements of the prior art cosmetic case to be a highly sophisticated quality product is that ornamental portions, regardless of any of the aforementioned ways of treatments and applications, should be undetachably united with the case body and the lid so as not to completely or even partly peel off or drop off the case body and the lid.

Such a requirement adversely gives a poor choice of readymade designs of the cosmetic case, which means that the customers take poorer initiative in choosing their favorite appearance of the case. Hence, the customers often cannot find their favorite designs of the cosmetic case, and this causes the customers to grudge buying.

SUMMARY OF THE INVENTION

The present invention is made allowing for the aforementioned disadvantages, and accordingly, it is an object of the present invention to provide a cosmetic case satisfying users' demands that all or even part of its decorative portion would not peel off nor drop off a case body and its lid and that customers themselves should be able to take greater initiative in choosing their favorite appearance of the case.

In order to attain the above-mentioned and other objects of the invention, an embodiment of the cosmetic case according to the present invention, which is comprised of a case body and an associated lid opening and closing the same, is characterized by including an ornamental exchangeable cover replaceably attached to at least either of the lid and the case body to cover them, a slide engagement member provided cooperatively between either the lid or the case body and the exchangeable cover to permit the exchangeable cover to slidably fit on either the lid or the case body, and a fastening member provided cooperatively between either the lid or the case body and the exchangeable cover to permit either the lid or the case body to hold and release the exchangeable cover along its sliding direction.

This embodiment of the cosmetic case satisfies users' demand that decorative portion would not peel off nor drop off the case body and its lid and enables customers to take greater initiative in choosing their favorite appearance of the case.

Another embodiment of the cosmetic case according to the present invention is characterized in that the slide engagement concave portion provided in either the member includes a exchangeable cover or one of the lid or the case body along a sliding direction of the cover, and a convex portion provided in the component without the concave portion and slidably fitted in the concave portion, and that the fastening member is an detachable projection elastically deformable in the concave portion and detachably mated with the convex portion.

This embodiment of the cosmetic case enables the exchangeable cover to slide on the lid or the case body by means of a slide guide mechanism of concave and convex portions to ensure a stable manipulability, and elastic deformation of the detachable projection facilitates its attachment and detachment to and from the convex portion.

Still another embodiment of the cosmetic case according to the present invention is characterized in that the concave and convex portions are provided in positions as desired along the sliding direction of the exchangeable cover, and that the concave portion has a dent the convex portion is detachably fitted in.

This embodiment of the cosmetic case enables the convex and concave portions of the slide guide mechanism to engage with each other in positions as desired along the sliding direction, and this reduces a slide manipulation and facilitates attachment and detachment of the exchangeable cover.

Further another embodiment of the cosmetic case according to the present invention, which is comprised of a case body and an associated lid opening and closing the same, is characterized by including an exchangeable cover replaceably attached to at least either of the lid and the case body to cover them, the exchangeable cover being elastically deformable and overlying the lid, a slide engagement member provided cooperatively between either the lid or the case body and the exchangeable cover to permit the exchangeable cover to slidably fit on either the lid or the case body, a fastening member provided cooperatively between either the lid or the case body and the exchangeable cover to permit either the lid or the case body to hold and release the exchangeable cover sliding on them, and a recessed portion provided in either the lid or the case body and permitting the exchangeable cover to deform for releasing the exchangeable cover from, the fastening member.

This embodiment of the cosmetic case satisfies users' demand that all or even part of the decorative portion would not peel off nor drop off the case body and the lid and enables the customers to take greater initiative in choosing their favorite appearance of the cosmetic case.

Yet another embodiment of the cosmetic case according to the present invention is characterized in that a holder member is provided cooperatively between either the lid or the case body and the exchangeable cover to fix the exchangeable cover to the lid or the case body.

This embodiment of the cosmetic case enables firm and secure fixing of the slidable exchangeable cover that is fastened to the lid and the case body.

Additional subjects set forth in this application and solutions thereto will be clarified in the descriptions of the embodiments of the present invention and the accompanying drawings.

DETAILED DESCRIPTION OF THE INVENTION

The best mode of a cosmetic case of the present invention will be described in various manners in detail in conjunction with the accompanying drawings.

EMBODIMENT 1

Figure 1:
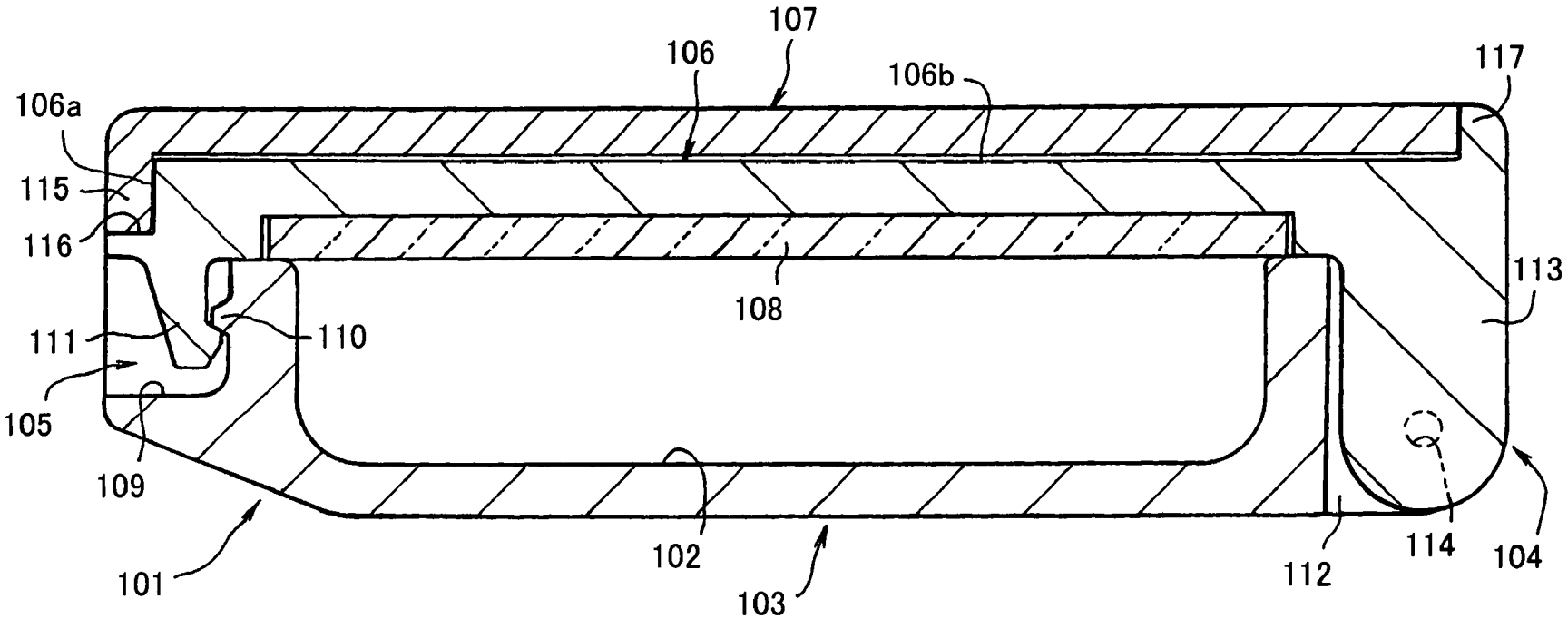
FIG. 1 is a side sectional view showing a first preferred embodiment of a cosmetic case according to the present invention.
Figure 2:
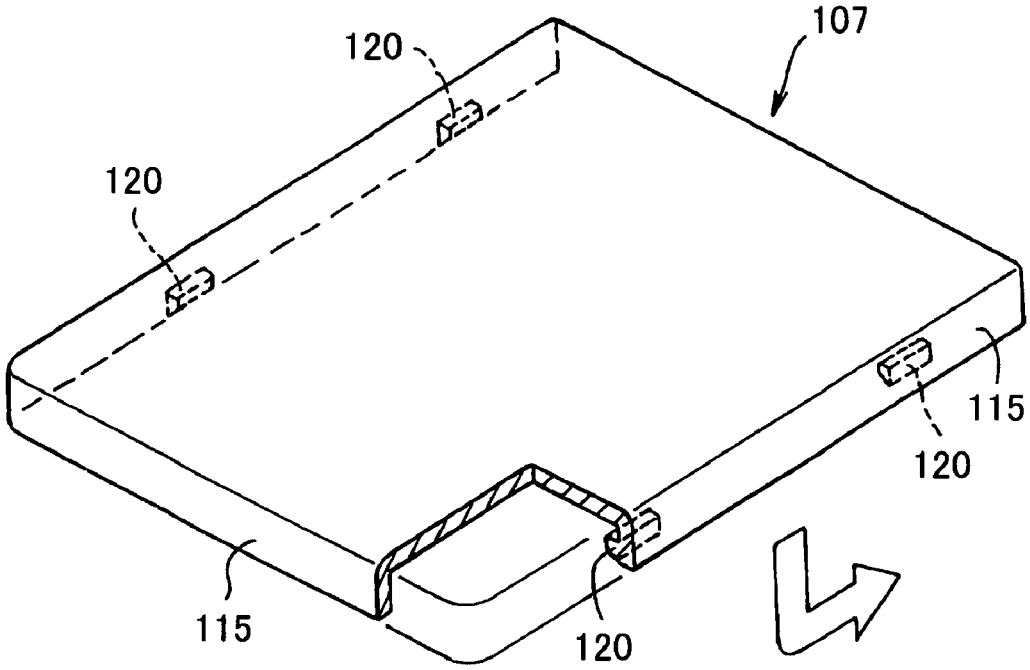
FIG. 2 is a partially taken-away exploded perspective view of a lid of the cosmetic case in FIG. 1.
Figure 2:
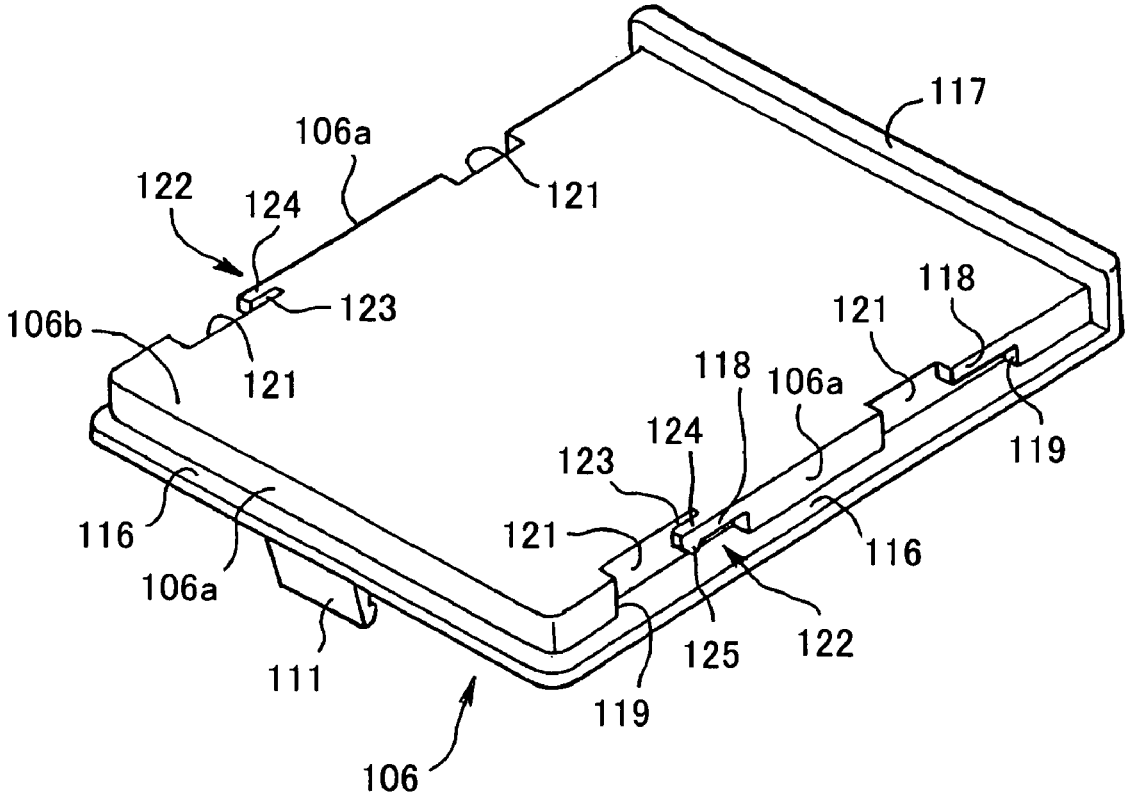
Figure 3:
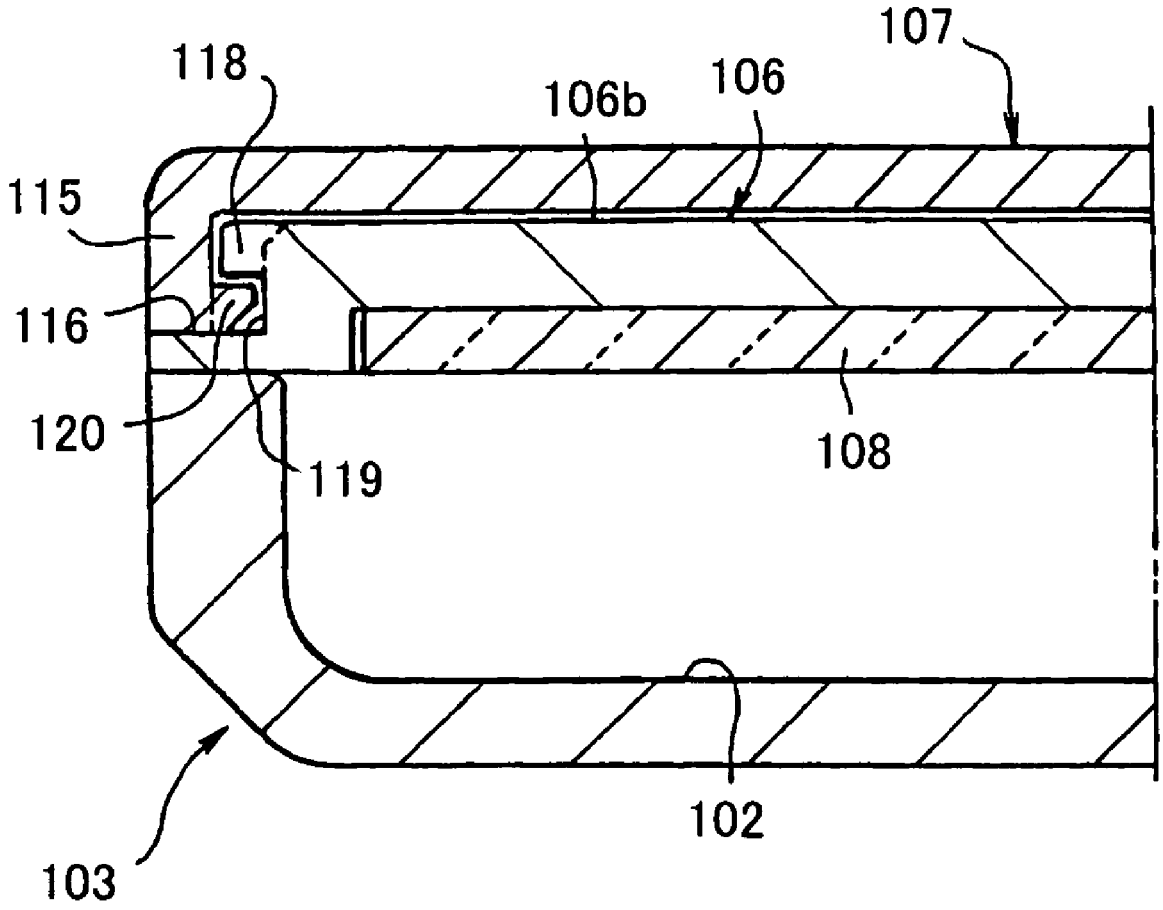
FIG. 3 is a partial front sectional view showing the cosmetic case in FIG. 1.

A cosmetic case 101 of a first embodiment is, as shown in FIGS. 1 to 3. Comprised of a dish-shaped case body 103 of synthetic resin provided with a container recession 102, a plate-shaped lid 106 of synthetic resin which is pivotally connected to a rear end of a longitudinal extension of the case body 103 by a hinge 104 and moves up and down to open and close the case body 103 and which is provided with a hook 105 detachably engaging the lid with a front end of the case body 103 to keep the case body closed, and a plate-shaped exchangeable cover 107 replaceably attached to at least either of the lid 106 and the case body 103, namely, to the lid 106 in the depicted example, to cover the lid 106 temporarily or permanently till replaced with additional one.

A material of the exchangeable cover 107 is not limited to synthetic resin, but alternatively, it may be of metal. Similarly, the exchangeable cover 107 may be attached to cover the case body, or may be attached to cover both the lid 106 and the case body 103. In the depicted example, the case body 103, the lid 106, and the exchangeable cover 107 all have their respective planar outer surfaces shaped in rectangular, but rather they may have a polygonal or circular shape. The lid 106 has a mirror 108 in its reverse side.

A hook 105 consists of a projection 110 raised in a concave portion 109 at the front end of the case body 103 and a hook member 111 hanging down from the front end of the lid 106 to be detachably mated with the projection 110. The hinge 104 is made up of a pair of hinge pieces 112 projected from the rear end of the case body 103, and a hinge block 113 extending from the rear end of the lid 106 and nipped between the hinge pieces 112, and a hinge pin 114 extending through the hinge block 113 and the opposite hinge pieces 112 in a transverse direction along a lateral extension of the case body 103.

The exchangeable cover 107 is for an ornamental use to the cosmetic case 101, or to the lid 106 in this embodiment. A variety of designs of the fashionable cover are provided so that customers can take a greater initiative in purchasing their favorite ones. Decorative portion of the exchangeable cover 107 is unseparably united with the exchangeable cover 107 in any well-known manner so that all or even part of the decorative portion would not peel off or drop off. The exchangeable cover 107 is attached to the lid 106 overlying it.

As will be recognized in the drawings, the exchangeable cover 107 has a bent edge 115 hanging down from its circumferential edge except for the rear end toward the lid 106.

Corresponding to this, the lid 106, which is shaped like a plate of considerable thickness, has a lateral protrusion 116 extended horizontally outward from a lower edge of its outer circumferential wall 106*a* except for the rear end to make a rest of the bent edge 115 of the exchangeable cover 107. At the rear end of the lid 106, a vertical wall 117 is raised upward from an upper surface 106*b* of the lid 106 between the opposite lateral locations of the lateral protrusion 116 transverse the lid 106, and the rear end of the exchangeable cover 107 touches' the vertical wall 117. Similarly, the frontal outer circumferential wall 106*a* at the front end of the lid 106 is in contact with the bent edge 115 at the front end of the exchangeable cover 107.

The lid 106 and the exchangeable cover 107 thus configured are slidably engaged with each other by means of a slide engagement member. The slide engagement member consists of a concave portion 119 of longitudinally appropriate length along the sliding direction recessed in positions along the outer circumferential wall 106*a* on the opposite lateral surfaces of the lid 106 between the lateral protrusion 116 and overhang 118 right above the same, and a convex portion 120 of shorter length than the concave portion 119 raised inward in positions at the lower end of the bent edge 115 on the opposite lateral surfaces of the exchangeable cover 107 and fitted in the concave portion 119 to permit the cover to slide on the lid.

In this embodiment, the concave and convex portions 119 and 120 are provided in appropriate positions of the lid 106 and the exchangeable cover 107, respectively, along the sliding movement of the exchangeable cover 107. The concave and convex portions 119 and 120 in the depicted example are provided in two locations, respectively, at a considerable distance from each other: one close to the front end in the lateral surfaces of the outer circumferential wall 106*a* and those of the bent edge 115, respectively, and the other close to the rear end, or alternatively, they may be provided in three or more locations, respectively. The concave and convex portions 119 and 120 are chamfered in appropriate outside and inside corners to ensure secure vertical engagement, thereby preventing the convex portion 120 from slipping off or disengaging from the concave portion 119 in vertical directions. The concave portion 119 has a dent 121 in more than one locations which makes a leading end of the concave portion in communication with the upper surface 106*b* of the lid to permit the convex portion 120 to be inserted in and released from the concave portion 119, and for that purpose, the concave portion 119 is defined in a L-shaped recessed portion along with the dent 121. Thus, the convex portion 120, first inserted in the dent 121, is then fitted in the concave portion 119 and still stays slidable between the overhang 118 and the lateral protrusion 116 through the concave portion 119 along the longitudinal extension of the lid 106.

In addition to that, a fastening member is provided cooperatively between the lid 106 and the exchangeable cover 107 to permit the lid 106 to hold and release the exchangeable cover 107 along its sliding direction. In this embodiment, the fastening member is a stopper projection 122 elastically deformable in the concave portion 119 and capable of catching the incoming convex portion 120 and releasing it. The stopper projection 122 consists of a vertically elastically deformable cantilever-shaped elastic piece 124 made by cutting the overhang 118 to form a slit 123 of a considerable length from the dent 121 toward the rear end of the lid 106, and a bump 125 extending downward at the tip of the elastic piece 124.

The convex portion 120 inserted in the convex portion 119 pushes up the bump 125 and therefore the elastic piece 124, and then slides beyond the bump for engagement and disengagement. In the depicted example, although the stopper projection 122 is provided in the concave portion 119 close to the front end of the lid 106, it may be located in another concave portion 119 close to the rear end, or otherwise, it may be provided in each of the opposite lateral surfaces of the lid 106, one close to the front end in one lateral surface and the other close to the rear end in the opposite lateral surface, and further alternatively, it may be in the concave portion 119 at any location.

Effects of the cosmetic case 101 can be implemented as follows: When a user of the cosmetic case 101 wants to exchange the current ornamental exchangeable cover 107 on the lid 106 with new one of different design, the user simply has to slide the current exchangeable cover 107 forward. The sliding movement of the exchangeable cover 107 enables the convex portion 120 to be released from the stopper projection 122 and reach the leading end of the concave portion 119. Then, pulling the exchangeable cover 107 from the lid 106 in this situation, the convex portion 120 is detached from the concave portion 119, slipping through the dent 121, and thus, the exchangeable cover 107 is completely removed from the lid 106.

In applying a new exchangeable cover 107 to the lid 106, the exchangeable cover 107 is laid over the lid 106 while the convex portion 120 is being put in the dent 121, and then, the convex portion 120 is inserted in the concave portion 119 to permit the exchangeable cover 107 to slide backward. The slide movement of the exchangeable cover 107 accordingly causes the convex portion 120 to slide through the concave portion 119 beyond the stopper projection 122 for secure engagement, which results in the bent edge 115 of the exchangeable cover 107 residing on the lateral protrusion 116 of the lid 106 and simultaneously causes the rear end of the exchangeable cover 107 and the front end of the bent edge 115 to come into contact with the vertical wall 117 of the lid and the front end of the outer circumferential wall 106*a*, respectively, which, eventually brings about a fully overlaid attachment of the exchangeable cover 107 onto the lid 106.

As has been described, since the cosmetic case 101 of this embodiment has the exchangeable cover 107 replaceably attached to cover the lid 106, the slide engagement member consisting of the concave and convex portions 119 and 120 provided cooperatively between the lid 106 and the exchangeable cover 107 and capable of slidably fitting the exchangeable cover 107 on the lid 106, and the fastening member of the stopper projection 122 provided cooperatively between the lid 106 and the exchangeable cover 107 to permit the lid 106 to securely hold the exchangeable cover 107, the current exchangeable cover 107 on the lid can be replaced with new one of different design, and thus, the customers have a greater choice of readymade designs of the cosmetic case 101, which means that the customers can take a greater initiative in choosing their favorite appearance of the cosmetic case. This advantageously stimulates the customers to purchase the products.

As in the prior art manufacturing procedure of an ornamental lid component, the decorative portion in this embodiment may be unseparably united with the exchangeable cover 107, and hence, the decorative portion would not even partly peel off or drop off, which enables the cosmetic case 101 to be provided as a highly sophisticated quality product in comparison with the prior art products.

Simple manipulation of the slide engagement member of the concave and convex portions 119 and 120 permit the user to attach and detach the exchangeable cover 107 to the cosmetic case without difficulty. Moreover, since the slide engagement member is made up of the concave portion 119 defined along the sliding direction in the lid 106 and the convex portion 120 provided in the exchangeable cover 107 and slidably fitted in the concave portion 119 while the fastening member or namely the stopper projection 122 consists of the elastic piece 124 elastically deformable in the concave portion 119 and capable of detachably mating with the convex portion 120 and the bump 125, the concave and convex portion 119 and 120 effectively serve as a guide mechanism to perform the relative slide movement between the lid 106 and the exchangeable cover 107, which ensures a stable manipulability, and the elastic deformation of the stopper projection 122 facilitates engagement and disengagement of the convex portion 120.

The concave and convex portions 119 and 120 are provided in appropriate positions as desired along the sliding direction of the exchangeable cover 107, and additionally, the dent 121 is provided for detachable fitting of the convex portion 120 in the concave portion 119. In thus manner, the slide guide mechanism works in appropriate position by permitting the convex portion 120 to be inserted in the concave portion 119 in position as desired, and this reduces a slide manipulation and facilitates attachment and detachment of the exchangeable cover 107.

When the case body 103, the lid 106, and the exchangeable cover 107 have their respective outer planer surfaces shaped in polygon or circle, for example, a concaved slide groove may be defined in the upper surface 106*b* of the lid 106 while a slide projection is extended from the exchangeable cover 107, so as to make a slide engagement member where the fastening member is cooperative with the concave slide groove and the slide projection.

Although the exchangeable cover 107 attached and detached to the lid 106 has been described in the aforementioned embodiment, alternatively, the exchangeable cover may be applied to the case body 103, and in such a case, the slide engagement member and the fastening member may be provided cooperatively between the case body 103 and the exchangeable cover 107. In this situation, the concave portion 119, the stopper projection 122, and the dent 121 may be provided in either the case body 103 or the exchangeable cover 107 while the convex portion 120 is provided in the component without them.

Further in this embodiment, the cosmetic case 101 having the hinge 104 and the hook 105 has been exemplified, but instead, any fixture structure such as that having screws and diameter fitting unit may be an alternative to the above-mentioned case body 103.

EMBODIMENT 2

A cosmetic case 201 of the second embodiment is, as shown in FIGS. 4 to 8, comprised of a dish-shaped case body 203 of synthetic resin provided with a container recession 202, a plate-shaped lid 206 of synthetic resin which is pivotally connected to a rear end of a longitudinal extension of the case body 203 by a hinge 204 and moves up and down to open and close the case body 203 and which is provided with a hook 205 detachably engaging the lid with a front end of the case body 203 to keep the case body closed, and a plate-shaped exchangeable cover 207 replaceably attached to at least either of the lid 206 and the case body 203, namely, to the lid 206 in the depicted example, to fully overlie the lid 206 temporarily or permanently till replaced with additional one.

A material of the exchangeable cover 207 is not limited to synthetic resin, but alternatively, it may be of metal. Similarly, the exchangeable cover 207 may be attached to cover the case body 203, or may be attached to cover both the lid 206 and the case body 203. In the depicted example, the case body 203, the lid 206, and the exchangeable cover 207 all have their respective planar outer surfaces shaped in rectangular, but rather they may have a polygonal or circular shape. The lid 206 has a mirror 208 in its reverse side.

A hook 205 consists of a projection 210 raised in a concave portion 209 at the front end of the case body 203 and a hook member 211 hanging downward from the front end of the lid 206 to be detachably mated with the projection 210. The hinge 204 is made up of a pair of hinge pieces 212 projected from the rear end of the case boy 203, and a hinge block 213 extending from the rear end of the lid 206 and nipped between the hinge pieces 212, and a hinge pin 214 extending through the hinge block 213 and the opposite hinge pieces 212 in a transverse direction along a lateral extension of the case body 203.

The exchangeable cover 207 is for an ornamental use to the cosmetic case 201, or to the lid 206 in this embodiment. A variety of designs of the fashionable cover are provided so that customers can take a greater initiative in purchasing their favorite ones. Decorative portion of the exchangeable cover 207 is unseparably united with the exchangeable cover 207 in any well-known manner so that all or even part of the decorative portion would not peel off or drop off.

For more full descriptions of this embodiment, the exchangeable cover 207 has a bent edge 215 hanging down from its circumferential edge except for the rear end toward the lid 206. Part of the bent edge 215 at the opposed lateral surfaces of the exchangeable cover 207 is provided with a slide rib 216 which is of a considerable length along the longitudinal extension of the exchangeable cover 207 and is raised inwardly in positions. The remaining part of the bent edge 215 at the front end of the exchangeable cover 207 is provided with two fastening projections 217 raised inwardly at an appropriate distance from each other along the lateral extension of the exchangeable cover 207.

The exchangeable cover 207 has stopper projections 218 extending backward from its rear end. The stopper projections 218 have their respective bumps 219 raised upward at the tips. The bent edge 215 along the three circumferential sides of the exchangeable cover 207 enables the cover to be fully elastically deformable at its part including the stopper projections 218 in the vicinity of the rear end.

Corresponding to this bent edge, the lid 206, which is shaped like a plate of considerable thickness, has a lateral protrusion 220 extended horizontally outward from a lower edge of its outer circumferential wall 206*a* except for the rear end to make a rest of the bent edge 215 of the exchangeable cover 207. At the rear end of the lid 206, a bulge 221 is raised upward from an upper surface 206*b* of the lid 206 between the opposite lateral locations of the lateral protrusion 220 transverse the lid 206, and the rear end of the exchangeable cover 207 touches the bulge 221.

Similarly, the frontal outer circumferential wall 206*a* at the front end of the lid 206 is in contact with the downward extension 215 at the front end of the exchangeable cover 207.

In the part of the outer circumferential wall 206*a* along the lateral surfaces of the lid 206, there are defined slide grooves 222 of a considerable length, extending backward from the front end of the lid 206 and recessed inward, so that the slide rib 216 can detachably inserted. With the slide grooves 222 and the slide rib 216, the slide engagement is accomplished to permit the exchangeable cover 207 to slidably engage with the lid 206. The slide rib 216 is inserted from the front end of the lid 206 into the associated slide groove 222 so as to slide along the longitudinal extension of the lid 206. The slide rib 216 and the associated slide groove 222 are chamfered in appropriate outside and inside corners to ensure secure vertical engagement, thereby preventing the slide rib from slipping off or disengaging from the slide groove in vertical directions.

Additional groove 223 is defined in the part of the outer circumferential wall 206*a* at the front end of the lid 206, which is recessed inward in locations corresponding to the positions of the fastening projections 217 in the exchangeable cover so as to permit the fastening projections 217 detachably fitted therein, and with the groove 223 and the fastening projections 217 cooperative with it, a holder member is provided to securely fix the exchangeable cover 207 to the lid 206. Also, the fastening projections 217 and the groove 223 are chamfered in appropriate outside and inside corners to ensure secure vertical engagement, thereby preventing the fastening projections from slipping off or disengaging from the groove in vertical directions. As the bent edge 215 at the front end of the exchangeable cover 207 comes in contact with the part of the outer circumferential wall 206*a* at the front end of the lid 206, the fastening projections 217 accordingly get mated with the groove 223.

The lid 206 is further provided with a recess 224 in its upper surface 206*b* facing with the exchangeable cover 207 and close to the bulge 221, and a vertical groove 225 is defined in the center of the lateral extension of the hinge block 213, extending from the bottom of the hinge block 213 to the bulge 221 except for a rear half area 213*a* of the hinge block 213 in thorough communication with the recess 224. At the upper end of the vertical groove 225 left open toward the recess 224, a fastening projection 226 is raised downward from the top side of the bulge 221, and with the fastening projection 226 and the stopper projection 218 mated with it, the fastening member is provided cooperatively between the lid 206 and the exchangeable cover 207 to securely fix the sliding cover to the lid 206.

The fastening projection 226 and the bumps 219 of the stopper projections are chamfered in appropriate outside and inside corners, respectively, to ensure secure longitudinal engagement, thereby preventing the stopper projections 218 from slipping off or disengaging from the fastening projection 226 in the sliding direction but permitting both the projections to disengage from each other in vertical directions. Then, as the rear end of the exchangeable cover 207 comes in contact with the bulge 221 at the rear end of the lid 206, the stopper projections 218 accordingly have their respective bumps 219 frictionally pushed back below and beyond the fastening projection 226. The recess 224 defines a space S between the exchangeable cover 207 and the lid 206 to allow the exchangeable cover 207 flexed by the fastening projection to be elastically deformed therein.

Figure 4:
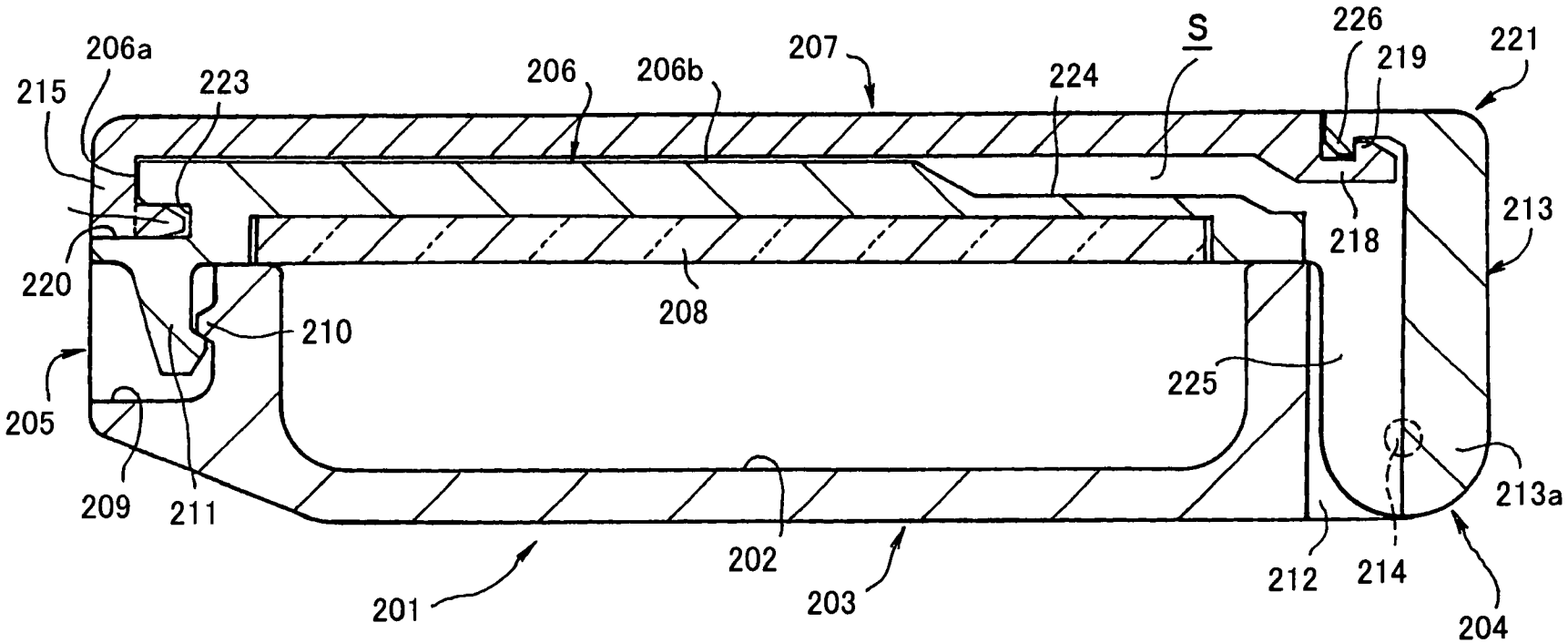
FIG. 4 is a side sectional view showing a second preferred embodiment of the cosmetic case according to the present invention

Effects of the cosmetic case 201 can be implemented as follows: When a user of the cosmetic case 201 wants to exchange the current ornamental exchangeable cover 207 on the lid 206 with new one of different design, the user simply has to press the rear end of the exchangeable cover 207 right above the recess 224 to elastically deform the cover. The elastic deformation of the exchangeable cover 207 enables the stopper projections 218 to be lowered under the fastening projection 226 as shown in FIG. 4, and thus, the disengagement of the fastening member is attained.

Figure 5:
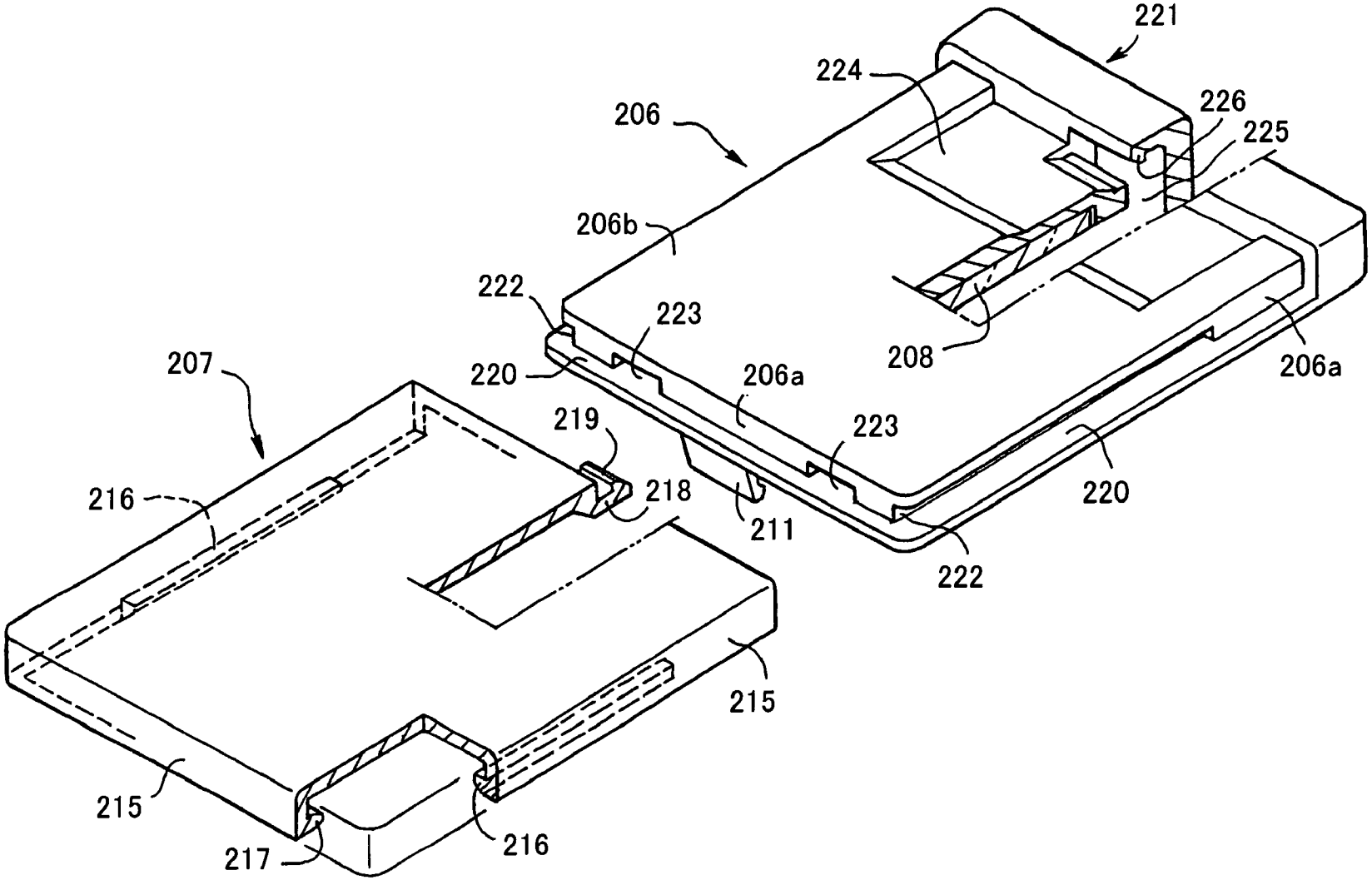
FIG. 5 is a partially taken-away exploded perspective view of a lid of the cosmetic case in FIG. 4.
Figure 6:
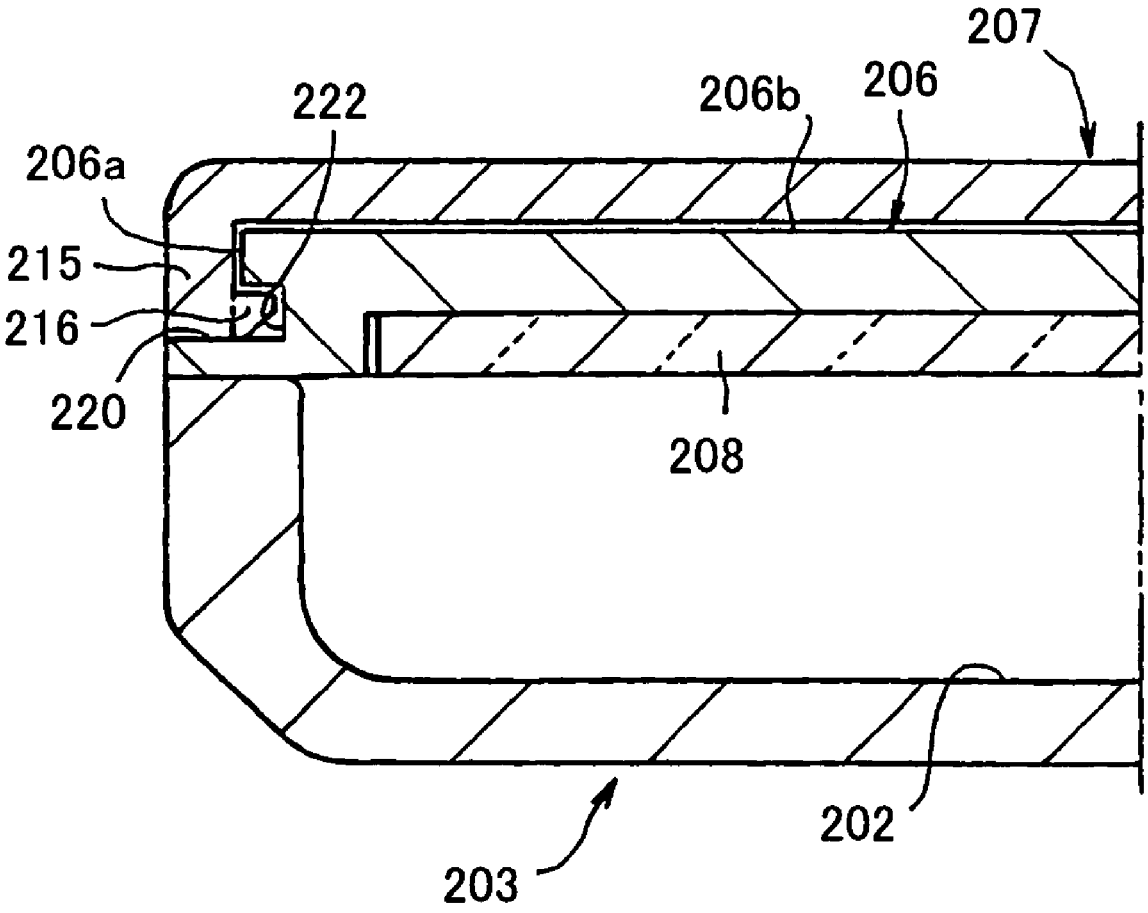
FIG. 6 is a partial front sectional view showing the cosmetic case in FIG. 4.
Figure 7:
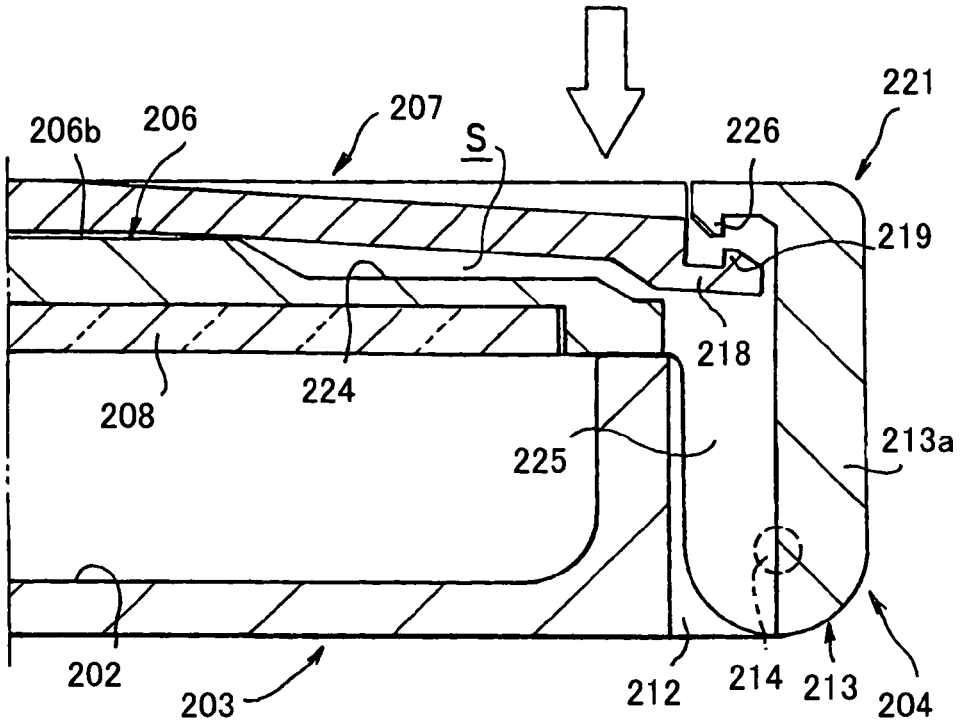
FIG. 7 is a partial enlarged side sectional view showing a major portion of the cosmetic case, with an exchangeable cover being elastically deformed and released from a fastening member.
Figure 8:
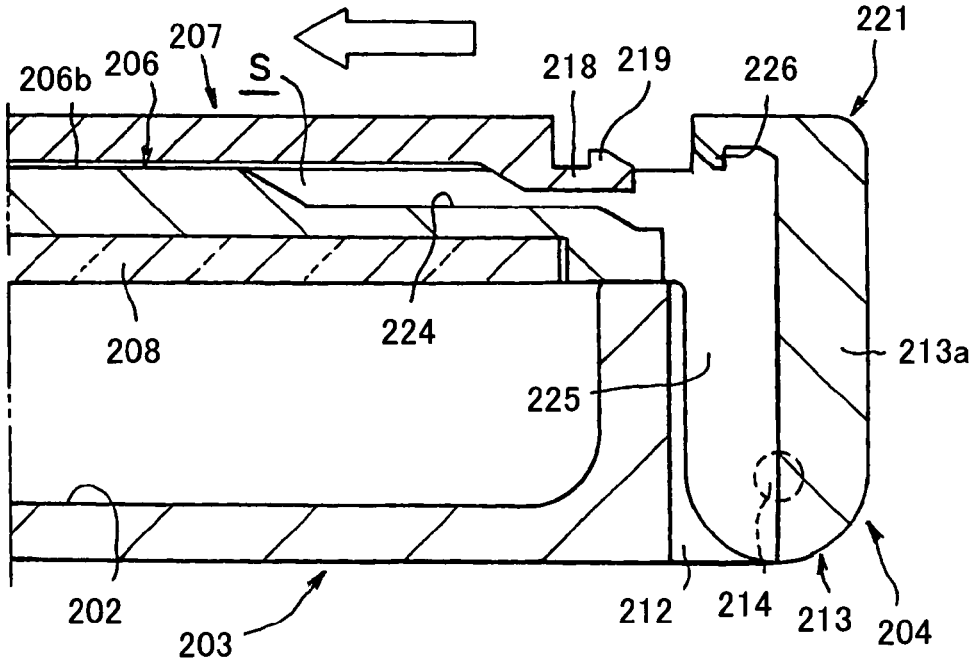
FIG. 8 is a partial enlarged side sectional view showing a major portion of the cosmetic case, with the exchangeable cover being slid and removed.

Then, pulling the exchangeable cover 207 forward from the lid 206 in this situation, the slide rib 216 moves along the groove 222, and accordingly, the stopper projections 218 are pulled out of the bulge 221 as illustrated in FIG. 5. Simultaneous with this, the fastening projection 217 is released from the groove 223, and thus, the exchangeable cover 207 is completely removed from the lid 206.

In applying a new exchangeable cover 207 to the lid 206, after inserting the slide rib 216 in the groove 222 from the front end of the lid 206, the exchangeable cover 207 is slid backward while the slide rib 216 is being fitted in the slide groove 222. When the rear end of the exchangeable cover 207 reaches the bulge 221, the stopper projections 218 slide below and beyond the fastening projection 226 for engagement, with the exchangeable cover 207 being deformed. At the same time, the fastening projection 217 is trapped in the groove 223, which results in the bent edge 215 of the exchangeable cover 207 residing on the lateral protrusion 220 of the lid 206 and simultaneously causes the rear end of the exchangeable cover 207 and the front end of the bent edge 215 to come into contact with the bulge 221 of the lid 206 and the front end of the outer circumferential wall 206*a*, respectively, which, eventually brings about a fully overlaid attachment of the exchangeable cover 207 onto the lid 206.

As has been described, since the cosmetic case 201 of this embodiment has the exchangeable cover 207 replaceably attached to cover the lid 206, the slide engagement member consisting of the slide rib 216 and the slide groove 222 provided cooperatively between the lid 206 and the exchangeable cover 207 and capable of slidably fitting the exchangeable cover 207 on the lid 206, the fastening member of the stopper projections 218 and the fastening projection 226 provided cooperatively between the lid 206 and the exchangeable cover 207 to permit the lid 206 to securely hold the slidable exchangeable cover 207, and the recess 224 defined in the lid 206 to permit the exchangeable cover 207 to be elastically deformed for the disengagement of the exchangeable cover 207 from the fastening member, the current exchangeable cover 207 on the lid can be replaced with new one of different design, and thus, the customers have a greater choice of readymade designs of the cosmetic case 201, which means that the customers can take a greater initiative in choosing their favorite appearance of the cosmetic case. This advantageously stimulates the customers to purchase the products.

As in the prior art manufacturing procedure of an ornamental lid component, the decorative portion in this embodiment may be unseparably united with the exchangeable cover 207, and hence, the decorative portion would not even partly peel off or drop off, which enables the cosmetic case 201 to be provided as a highly sophisticated quality product in comparison with the prior art products.

Simple manipulation of the slide engagement member of the slide rib 216 and the slide groove 222 can permit the user to attach and detach the exchangeable cover 207 to and from the cosmetic case without difficulty. Moreover, since the holder member is made up of the fastening projection 217 and the associated groove 223, and hence, the exchangeable cover 207 can securely and firmly be fixed to the lid 206.

Additionally, the slide groove 222 and the slide rib 216 build up a guide mechanism to facilitate the relative slide movement between the lid 206 and the exchangeable cover 207, and thus, a stable manipulability can be ensured.

Furthermore, the exchangeable cover 207 is permitted to be elastically deformed in the recess 224 defined in the lid 206, and hence, engagement and disengagement of the fastening projection 226 with and from the stopper projections 218 can be facilitated. The fastening projection 226 and the stopper projections 218 are mated in appropriate outside and inside corners to ensure secure engagement in the sliding direction, thereby preventing the stopper projections from slipping off or disengaging from the fastening. Configured in this manner, the exchangeable cover 207 can also be securely fixed to the lid 206, and when a significant shock is applied to the cosmetic case 201 because the user drops it, for example, the exchangeable cover 207 would not drop off so easily.

When the case body 203, the lid 206, and the exchangeable cover 207 have their respective outer planer surfaces shaped in polygon or circle, a concaved slide groove may be defined in the upper surface 206*b* of the lid 206 while a slide projection is extended from the exchangeable cover 207, so as to make a slide engagement member where the fastening member is cooperative with the concave groove and the slide projection.

Although the exchangeable cover 207 attached and detached to the lid 206 has been described in the aforementioned second embodiment, alternatively, the exchangeable cover may be applied to the case body 203, and in such a case, the side engagement member, the fastening member, and the holder member may be provided cooperatively between the case body 203 and the exchangeable cover 207 while the recess 224 is defined in the case body 203.

Further in this second embodiment, the cosmetic case 201 having the hinge 204 and the hook 205 has been exemplified, but instead, any fixture structure such as that having screws and diameter fitting unit may be an alternative to the above-mentioned case body 203.

INDUSTRIAL APPLICABILITY

As has been detailed by way of example, a cosmetic case according to the present invention comprised of a case body and an associated lid opening and closing the same is adapted to have an ornamental exchangeable cover replaceably attached to at least either of the lid and the case body to cover them, and hence, the cosmetic case satisfies users' demand that all or even part of decorative portion would not peel off nor drop off the case body and its lid and enables customers to take greater initiative in choosing their favorite appearance of the case.

What is claimed:

1. A cosmetic case, comprising:

a case body, an associated lid opening and closing the case body;

an exchangeable cover replaceably attached to either the lid or the case body to cover the lid or the case body, the exchangeable cover being configured to be slidable in a direction substantially parallel to a top surface of either the lid or the case body;

a slide engagement member provided cooperatively between either the lid or the case body and the exchangeable cover to permit the exchangeable cover to slide into an attaching position where the exchangeable cover is detachably attached to either the lid or the case body;

a fastening member provided cooperatively between either the lid or the case body and the exchangeable cover to permit either the lid or the case body to hold and release the exchangeable cover along its sliding direction; and a dent provided adjacent to the slide engagement member for permitting the exchangeable cover to detach from the lid or the case body, wherein the slide engagement member has a concave portion provided in either the exchangeable cover or one of the lid or the case body along a sliding direction of the cover, and a convex portion provided in either the lid or the case body or the exchangeable cover and configured to slidably fit in the concave portion, wherein the fastening member is a detachable projection elastically deformable in the concave portion and detachably mated with the convex portion, and wherein the concave and convex portions are provided in positions as desired along the sliding direction of the exchangeable cover, and the concave portion has the dent configured to detachably fit in the convex portion.

* * * * *